US006622703B2

(12) United States Patent
Fukui et al.

(10) Patent No.: US 6,622,703 B2
(45) Date of Patent: Sep. 23, 2003

(54) FUEL INJECTION CONTROL DEVICE FOR INTERNAL COMBUSTION ENGINE

(75) Inventors: Wataru Fukui, Tokyo (JP); Toshiki Kurokawa, Hyogo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/996,599

(22) Filed: Nov. 30, 2001

(65) Prior Publication Data

US 2003/0010322 A1 Jan. 16, 2003

(30) Foreign Application Priority Data

Jul. 10, 2001 (JP) ..... 2001-209429

(51) Int. Cl.[7] ..... F02M 51/00
(52) U.S. Cl. ..... 123/478; 701/104
(58) Field of Search ..... 123/478, 480, 123/490; 701/110–114

(56) References Cited

U.S. PATENT DOCUMENTS

| | | | | |
|---|---|---|---|---|
| 4,296,722 A | * | 10/1981 | Furuhashi et al. | 123/492 |
| 5,315,979 A | * | 5/1994 | Kako | 123/478 |
| 5,492,101 A | * | 2/1996 | Saito et al. | 123/491 |
| 6,122,589 A | * | 9/2000 | Yamaguchi et al. | 701/106 |

FOREIGN PATENT DOCUMENTS

| | | |
|---|---|---|
| DE | 39 92 570 C2 | 11/1990 |
| DE | 42 14 114 C2 | 11/1992 |
| DE | 197 43 248 A1 | 4/1999 |
| JP | 2000-265894 | 9/2000 |

* cited by examiner

*Primary Examiner*—John Kwon
(74) *Attorney, Agent, or Firm*—Sughrue Mion, PLLC

(57) ABSTRACT

To provide a fuel injection control device for an internal combustion engine which can suppress body vibrations, shocks, etc. and can control the fuel injection quantities during transitional periods easily and effectively in a simple manner.

The fuel injection control device includes a crank angle sensor for detecting one angle reference position of at least the suction stroke or earlier strokes or two cylinders whose strokes shift from each other by 360 degrees of crank angle in a four-cycle multi-cylinder engine; various sensors for detecting the operating conditions of the engine; and a control section for determining the appropriate fuel injection quantity for each cylinder of the engine based on engine revolution information derived from the detected cycle of angle reference position detection signals and on operating condition detection signals, in which ½ of the fuel injection quantity determined based on the engine revolution information derived from the detected cycle of the angle reference position detection signals of each of the two cylinders and on the operating condition detection signals is injected simultaneously into the two cylinders.

11 Claims, 7 Drawing Sheets

FUEL INJECTION CONTROL DEVICE FOR INTERNAL COMBUSTION ENGINE

BACKGROUND OF THE INVENTION

1. Field of the Invention

The present invention relates to a fuel injection control device for an internal combustion engine.

2. Description of the Prior Art

FIG. 5 is a block diagram showing a typical conventional fuel injection control device for an internal combustion engine, In the figure, reference numeral 1 denotes a control section which consists of a waveform shaping circuit 1-1 for shaping the outputs of various input sensors, a calculation section 1-2 for controlling fuel and ignition, an injector drive circuit 1-3 for driving injectors, and an ignition drive circuit 1-4 for driving ignition, Reference numeral 2 denotes a cam angle sensor for detecting phase angle position of the cam shaft, reference numeral 3 denotes a crank angle sensor for detecting angle reference position of cranks, reference numeral 4 denotes various sensors for detecting operating conditions, reference numerals 5 and 6 denote fuel injectors for respective cylinders, and reference numerals 7 and 8 denote ignition coils.

Now the operation of the fuel injection control device will be described with reference to FIGS. 6 and 7.

FIG. 6 is an operation timing chart of a conventional fuel injection control device for an internal combustion engine.

In FIG. 6, for example, an output signal S1 from the can angle sensor 2 and an output signal S2 from the crank angle sensor 3 are shaped by the waveform shaping circuit 1-1 and supplied to the calculation section 1-2. Then quantities of fuel for the injectors 5 and 6 are calculated by a fuel quantity calculation section 1-2*a* and ignition timings of the ignition coils 7 and 8 are calculated by an ignition timing calculation section 1-2*b*. The calculation results of fuel quantities are supplied to the injectors 5 and 6 as drive signals S3 and S4, respectively, via the injector drive circuit 1-3. The calculation results of ignition timings are supplied to the ignition coils 7 and 8 as drive signals S5 and S6, respectively, via the ignition drive circuit 1-4.

FIG. 7 is a control flowchart of the conventional fuel injection control device for an internal combustion engine.

In Steps ST1 to ST3, the period of revolution of the engine is calculated. Based on the calculation results, the base quantity of fuel is calculated in Step ST4. Next, in Step ST5, it is checked whether a cam angle signal was input during a crank angle interruption. If it was, fuel injection quantity INJ2 (injector 6) is determined (Step ST6). If no cam angle signal was input, fuel injection quantity INJ1 (injector 5) is determined (Step ST7). The injector drive is turned on (Step ST8), and finally the time of the current interruption of the crank angle is memorized (Step ST9). Then the process returns to the beginning.

Conventional fuel injection control devices for internal combustion engines, which are configured as described above, have the following problems.

With the conventional fuel injection control devices for internal combustion engines, if the fuel injection quantity during acceleration is controlled for each cylinder, it is difficult for all the fuel injected this time to enter the cylinders because of a time delay before the fuel injected by injectors reaches the cylinders through suction valves. Consequently, the air-fuel ratio of the current air-fuel mixture becomes lean to the extent that fuel remains upstream of the suction valves. This reduces the torque delivered by the engine. On the other hand, the air-fuel ratio of the next air-fuel mixture becomes richer by the amount of the extra air-fuel mixture which remained upstream of the suction valves. This extremely increases or decreases the torque delivered by the engine. The increases and decreases in the torque delivered by the engine increases car body vibrations and shocks, making it difficult to control the fuel injection quantity during transitional periods.

BRIEF SUMMARY OF THE INVENTION

Object of the Invention

The present invention has been made to solve the above problems. Its object is to provide a fuel injection control device for an internal combustion engine which can control fuel injection quantities easily and simply by regulating them in such a way as to suppress car body vibrations and shocks.

Summary of the Invention

A fuel injection control device for an internal combustion engine set forth in claim 1 of the invention comprises angle detection means for detecting one angle reference position of at least the suction stroke or earlier strokes of two cylinders whose strokes shift from each other by 360 degrees of crank angle in a four-cycle multi-cylinder engine; operating condition detection means for detecting the operating conditions of the engine; and fuel injection control means for determining the appropriate fuel injection quantity for each cylinder of the engine based on engine revolution information derived from the detected cycle of angle reference position detection signals obtained by the above described angle detection means and on operating condition detection signals obtained by the above described operating condition detection means, wherein ½ of the fuel injection quantity determined based on the engine revolution information derived from the detected cycle of the angle reference position detection signals of one of the above described two cylinders and on the above described operating condition detection signals is injected simultaneously into the above described two cylinders, and ½ of the fuel injection quantity determined based on the engine revolution information derived from the detected cycle of the angle reference position detection signals of the other of the above described two cylinders and on the above described operating condition detection signals is injected simultaneously into the above described two cylinders.

A fuel injection control device for an internal combustion engine set forth in claim 2 of the invention comprises angle detection means fitted in the crank shaft of a four-cycle multi-cylinder engine and detecting angle reference position of the engine; specific-cylinder detection means fitted in the cam shaft of the above described internal combustion engine and recognizing specific cylinders of the engine; operating condition detection means for detecting the operating conditions of the engine; and fuel injection control means for determining the appropriate fuel injection quantity for each cylinder of the engine based on engine revolution information derived from the detected cycle of angle reference position detection signals obtained by the above described angle detection means and on operating condition detection signals obtained by the above described operating condition detection means, wherein a particular proportion of the fuel injection quantity determined based on the engine revolution information derived from the detected cycle of the angle reference position detection signals from the above described angle detection means and on the above described operating condition detection signals is divided into multiple injections, based on recognition information obtained by the above described specific-cylinder detection means.

A fuel injection control device for an internal combustion engine set forth in claim 3 of the invention is the fuel injection control device according to claim 2, wherein the number of divisions of the fuel injection quantity determined based on the engine revolution information derived from the detected cycle of the angle reference position detection signals from the above described angle detection means and on the operating condition detection signals is changed according to the operating conditions of the engine.

A fuel injection control device for an internal combustion engine set forth in claim 4 of the invention is the fuel injection control device according to claim 2, wherein the particular proportion of the fuel injection quantity determined based on the engine revolution information derived from the detected cycle of the angle reference position detection signals from the above described angle detection means and on the operating condition detection signals is changed according to the operating conditions of the engine.

A fuel injection control device for an internal combustion engine set forth in claim 5 of the invention is the fuel injection control device according to claim 4, wherein the operating conditions of the engine which determine the above described particular proportion of the fuel injection quantity is changed according to at least engine speed.

A fuel injection control device for an internal combustion engine set forth in claim 6 of the invention is the fuel injection control device according to claim 4, wherein the operating conditions of the engine which determine the above described particular proportion of the fuel injection quantity is changed according to at least the temporal variation in engine speed.

A fuel injection control device for an internal combustion engine set forth in claim 7 of the invention is the fuel injection control device according to claim 4, wherein the operating conditions of the engine which determine the above described particular proportion of the fuel injection quantity is changed according to at least temperature information.

A fuel injection control device for an internal combustion engine set forth in claim 8 of the invention is the fuel injection control device according to claim 4, wherein the operating conditions of the engine which determine the above described particular proportion of the fuel injection quantity is changed according to at least the position of the transmission gear of the engine, A fuel injection control device for an internal combustion engine set forth in claim 9 of the invention is the fuel injection control device according to claim 4, wherein the operating conditions of the engine which determine the above described particular proportion of the fuel injection quantity is changed according to at least the throttle opening of the engine.

A fuel injection control device for an internal combustion engine set forth in claim 10 of the invention is the fuel injection control device according to claim 4, wherein the operating conditions of the engine which determine the above described particular proportion of the fuel injection quantity is changed according to at least temporal variation in the throttle opening of the engine.

A fuel injection control device for an internal combustion engine set forth in claim 11 of the invention is the fuel injection control device according to any of claims 2 to 10, wherein the above described multiple split injections are mainly carried out at least at a point just after the end of the suction stroke and at a point just before the start of the suction stroke.

DETAILED DESCRIPTION OF THE PREFERRED EMBODIMENTS

Embodiments of the present invention will be described below with reference to the drawings.

First Embodiment

Figure 1:
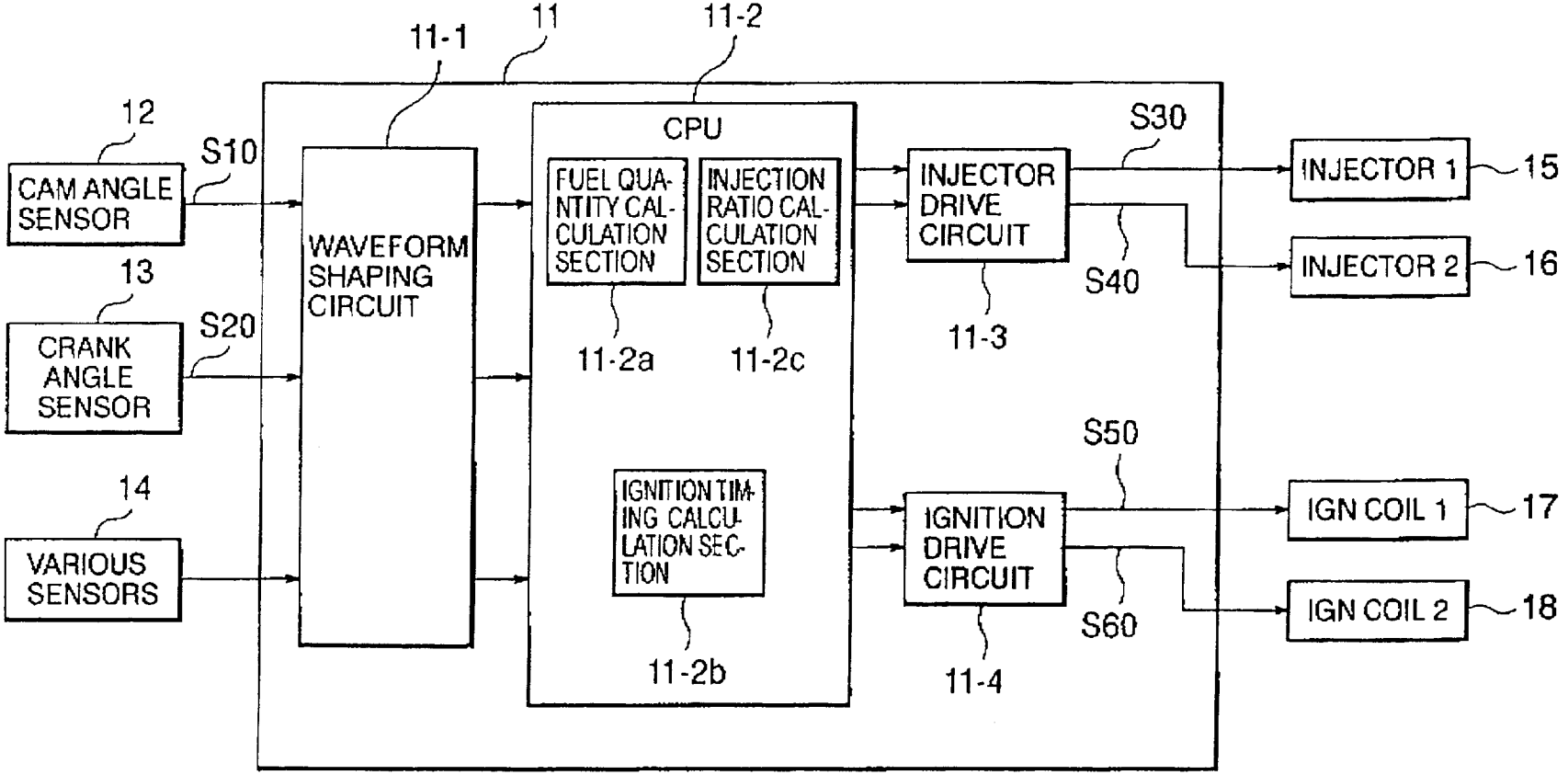
FIG. 1 is a block diagram showing a first embodiment of the present invention.

FIG. 1 is a block diagram showing a first embodiment of the present invention.

In the figure, reference numeral 11 denotes a control section serving as fuel injection control means and consisting of a waveform shaping circuit 11-1 for shaping the outputs of various input sensors, a calculation section 11-2 for controlling fuel and ignition, an injector drive circuit 11-3 for driving injectors, and an ignition drive circuit 11-4 for driving ignition. The calculation section 11-2 includes an injection ratio calculation section 11-2*c* in addition to a fuel quantity calculation section 11-2*a* and ignition timing calculation section 11-2*b*. Reference numeral 12 denotes a cam angle sensor serving as specific-cylinder detection means for detecting phase angle position of the cam shaft, reference numeral 13 denotes a crank angle sensor serving as angle detection means for detecting angle reference position of cranks, reference numeral 14 denotes various sensors serving as operating condition detection means for detecting operating conditions, reference numerals 15 and 16 denote fuel injectors for respective cylinders, and reference numerals 17 and 18 denote ignition coils.

Now the operation of the fuel injection control device will be described with reference to FIGS. 2 and 4.

Figure 2:
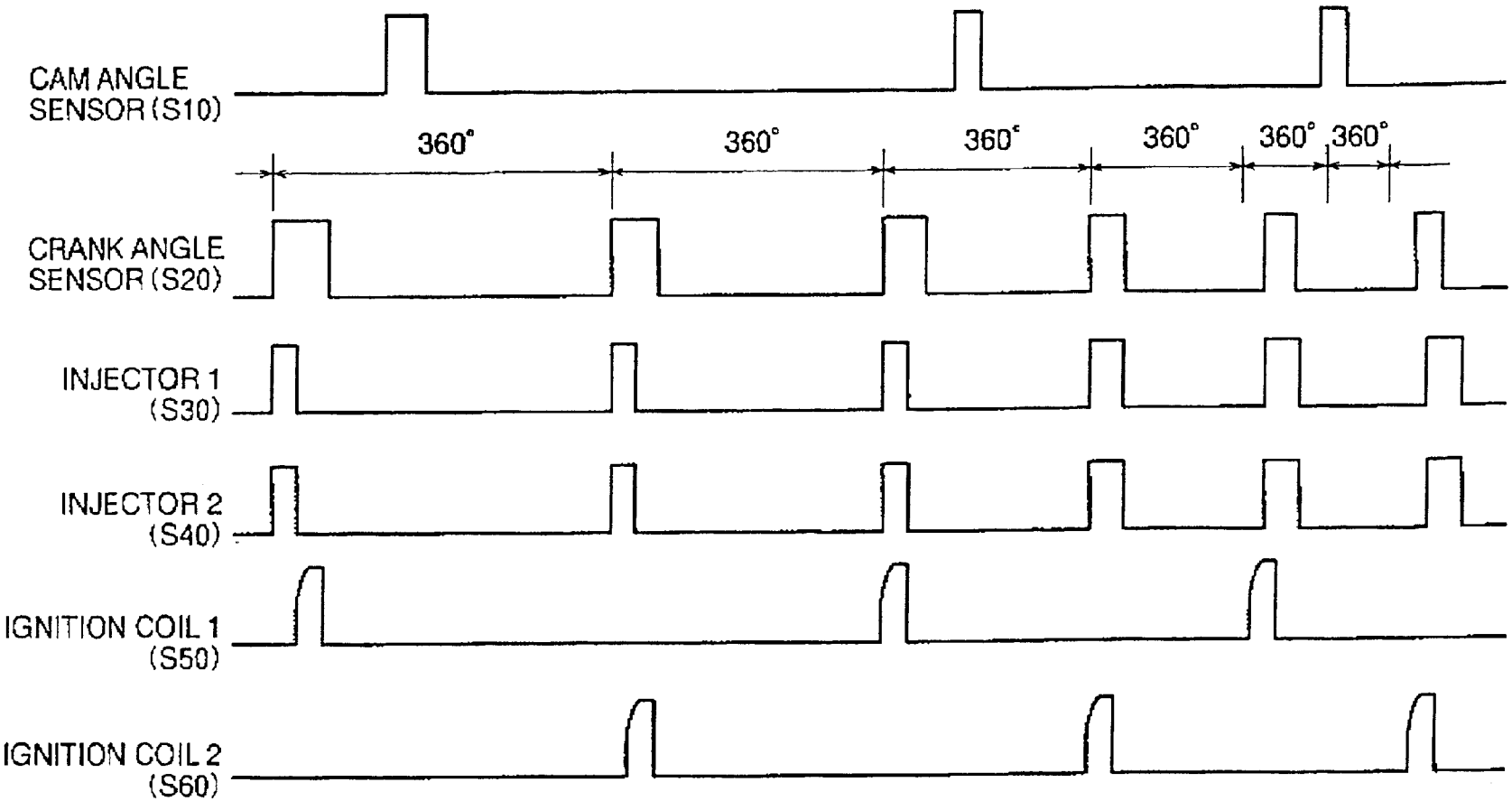
FIG. 2 is a timing chart illustrating the operation of the first embodiment of the present invention.

FIG. 2 is an operation timing chart of the fuel injection control device for an internal combustion engine according to this embodiment.

In FIG. 2, for example, an output signal S10 from the cam angle sensor 12 and an output signal S20 from the crank angle sensor 13 are shaped by the waveform shaping circuit 11-1 and supplied to the calculation section 11-2. Then quantities of fuel for the injectors 15 and 16 are calculated by the fuel quantity calculation section 11-2*a* and ignition timings of the ignition coils 17 and 18 are calculated by the ignition timing calculation section 11-2*b*. The calculation results of fuel quantities are supplied to the injection ratio calculation section 11-2*c*, which calculates the injection ratio between the injectors 15 and 16. The calculation results produced by the injection ratio calculation section 11-2*c* are supplied to the injectors 15 and 16 as drive signals S30 and S40, respectively, via the injector drive circuit 11-3. The calculation results of ignition timings are supplied to the ignition coils 17 and 18 as drive signals S50 and S60, respectively, via the ignition drive circuit 11-4.

This embodiment shifts injection timings of the injectors 15 and 16 by 360 degree depending on the operating conditions of the engine instead of fixing the shift in injection timing between the injectors 15 and 16 at 720 degrees as is conventionally the case. This is effective in reducing the delay before the injected fuel enters the cylinders. Regarding calculation of the fuel injection quantities of 360 degrees, the ratio of fuel injection quantities for normal 720-degree, phase-shifted injections is changed according to operation information and appropriate quantities of fuel are injected into the cylinders 360 degrees out of phase from each other.

Figure 3:
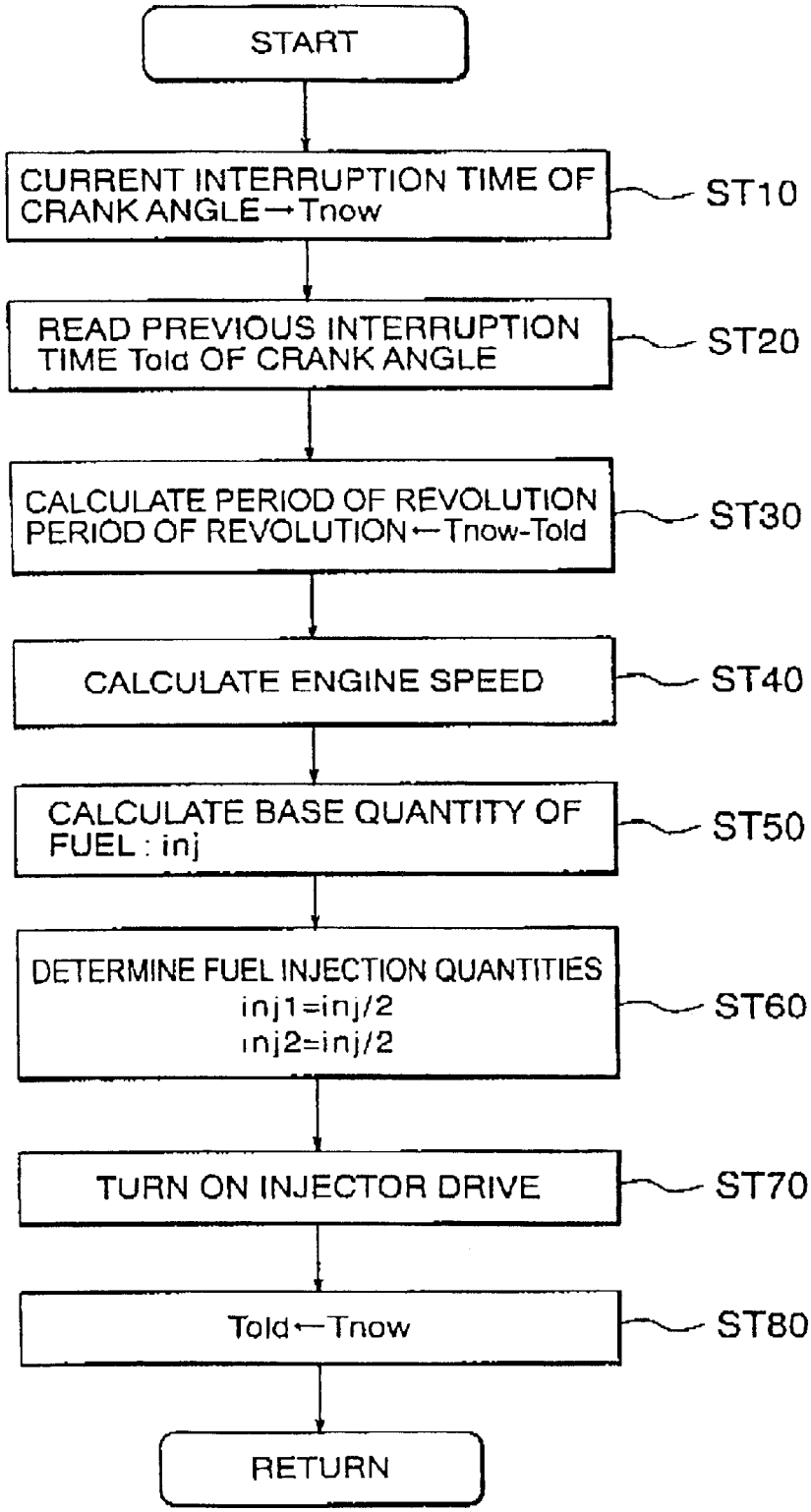
FIG. 3 is a flowchart illustrating the operation of the first embodiment of the present invention.

FIG. 3 1s a control flowchart of the fuel injection control device for an internal combustion engine according to this embodiment.

In Steps ST10 to ST40, the period of revolution of the engine is calculated. Based on the calculation results, the base quantity of fuel is calculated in Step ST50. Next, in Step ST60, fuel injection quantity INJ2 (injector 16) and fuel injection quantity INJ1 (injector 15) are determined. The injector drive is turned on (Step ST70), and finally the time of the current interruption of the crank angle is memorized (Step ST80). Then the process returns to the beginning.

In this way, by injecting a particular proportion (½) of the fuel injection quantity earlier than the normal injection timing, this embodiment facilitates vaporization on port walls, reducing fuel delivery delay due to the port length and thus resulting in good combustion. This suppresses car body vibrations, shocks, etc., making it possible to control fuel injection quantities easily and effectively in a simple manner, especially during transitional periods.

Second Embodiment

Figure 4:
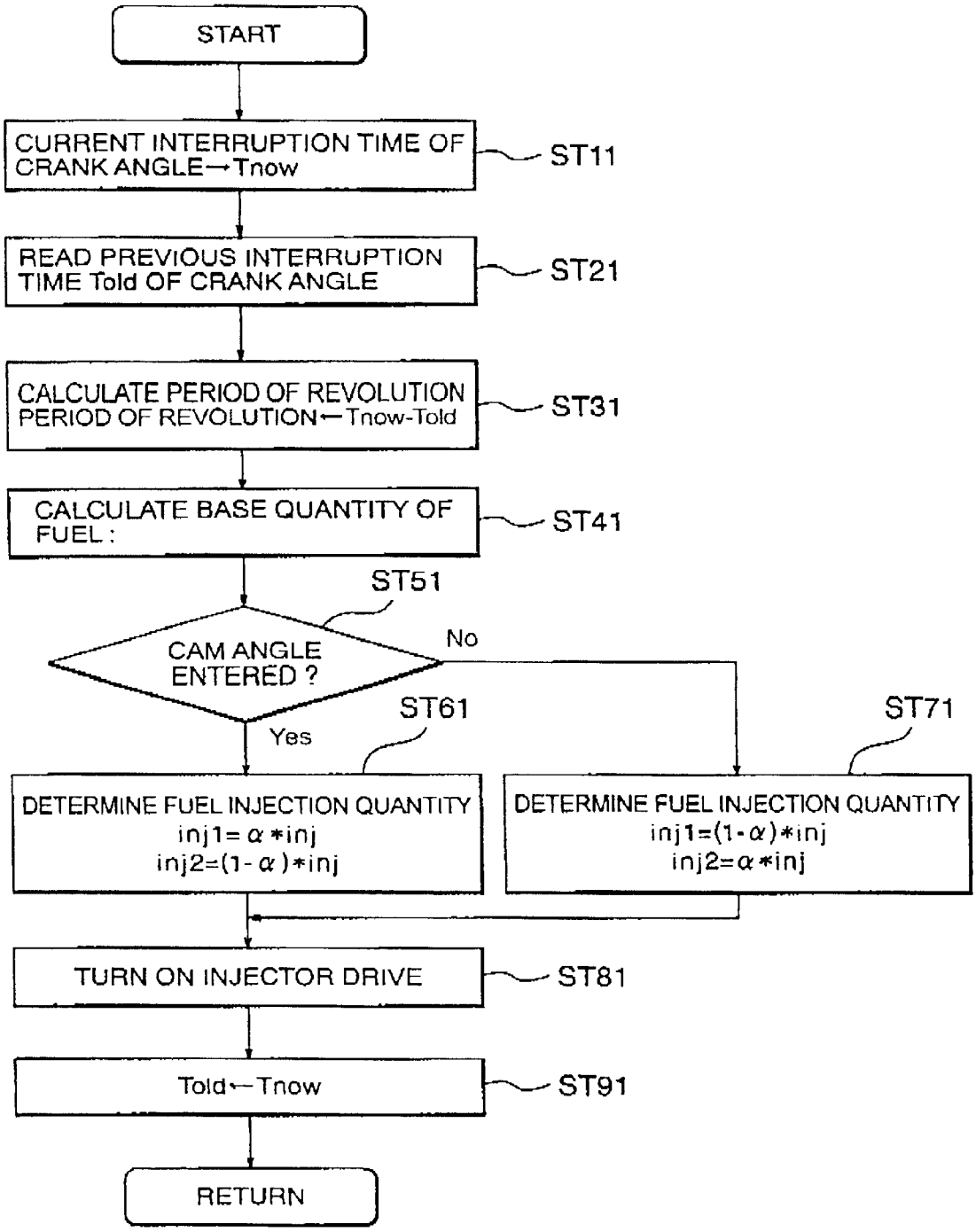
FIG. 4 is a flowchart illustrating the operation of a second embodiment of the present invention.
Figure 5:
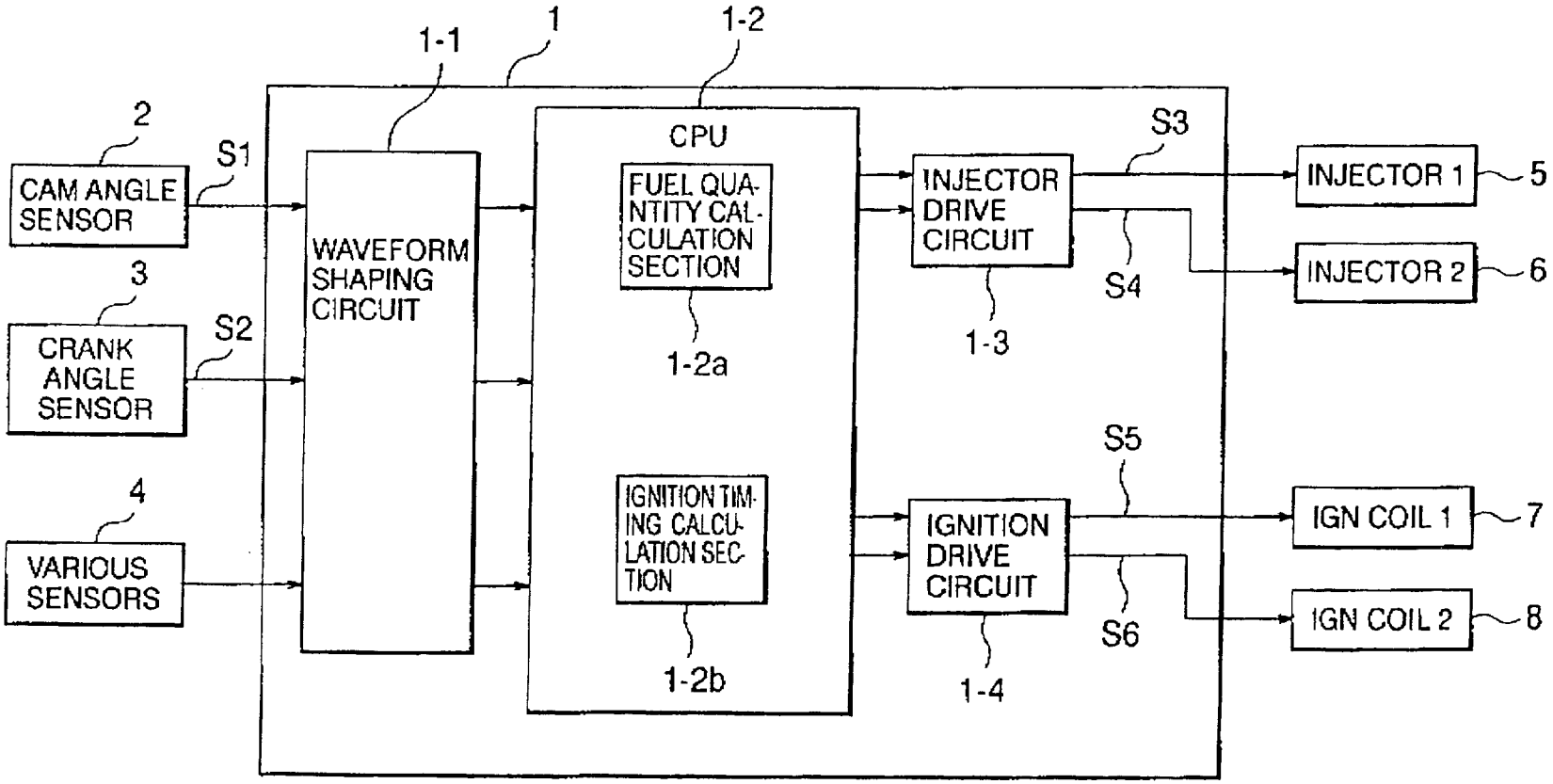
PRIOR ART FIG. 5
FIG. 5 is a block diagram showing a conventional fuel injection control device for an internal combustion engine.
Figure 6:
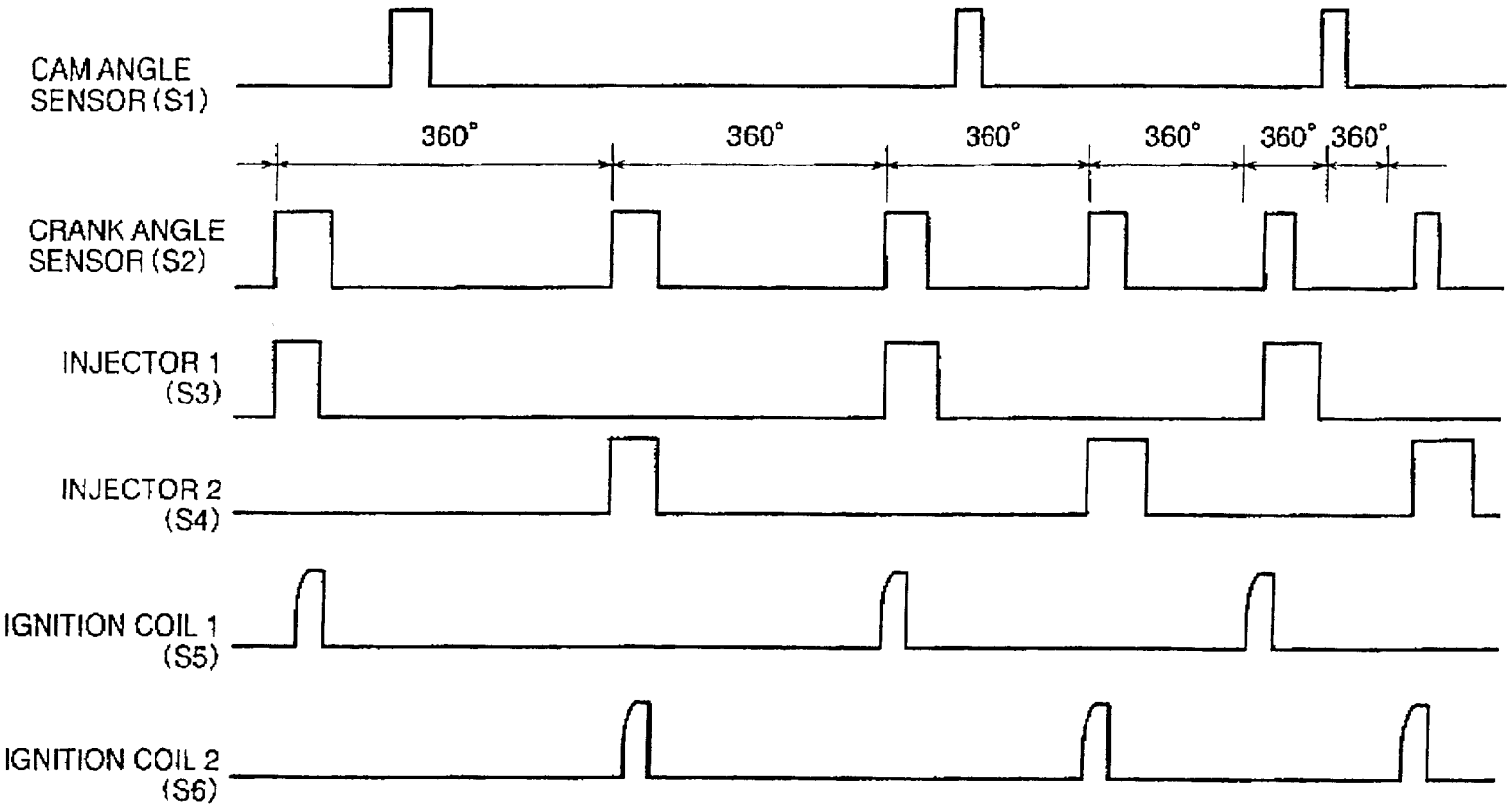
PRIOR ART FIG. 6
FIG. 6 is a timing chart illustrating the operation of the conventional fuel injection control device for an internal combustion engine.
Figure 7:
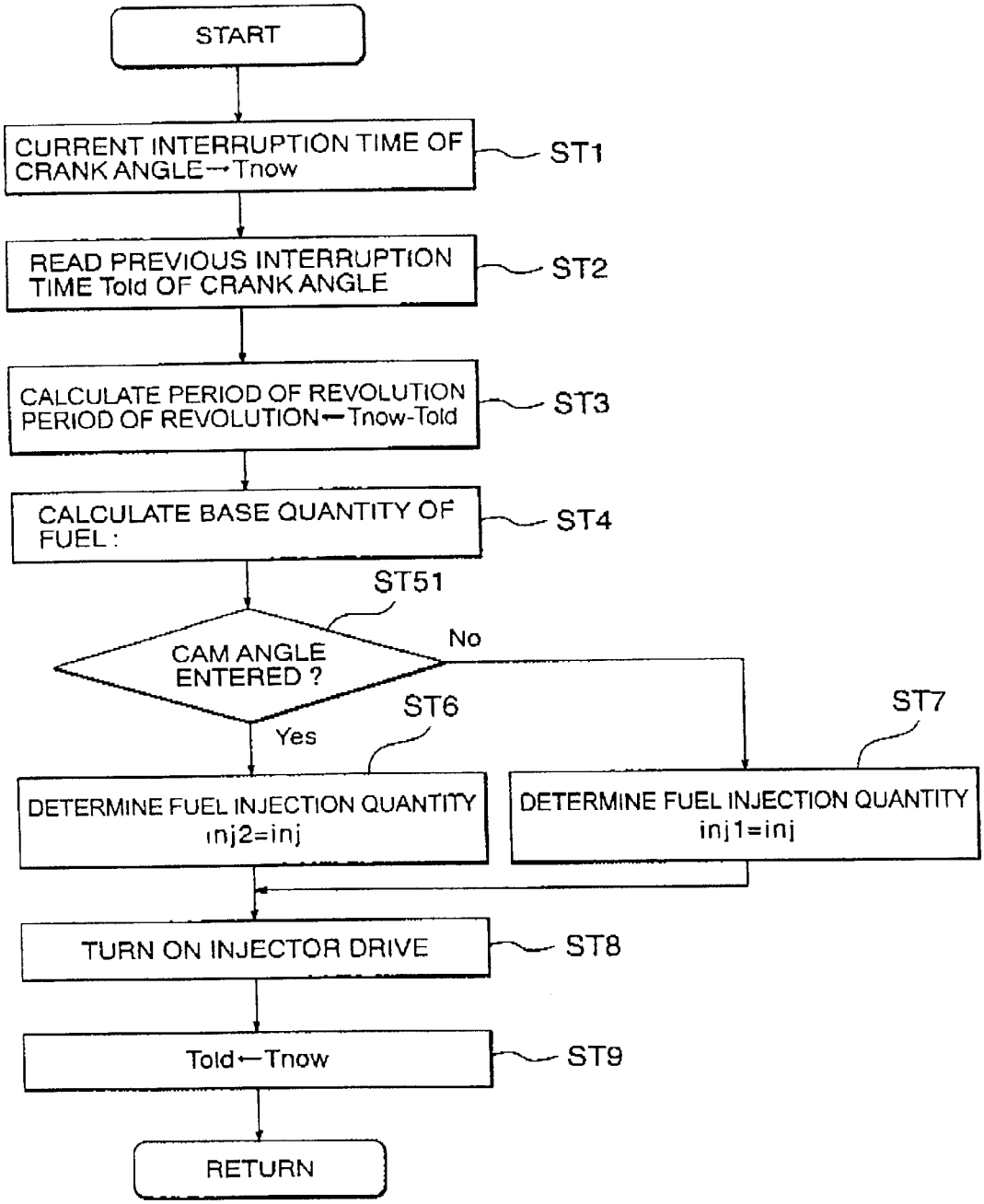
PRIOR ART FIG. 7
FIG. 7 is a flowchart illustrating the operation of the conventional fuel injection control device for an internal combustion engine.

FIG. 4 is a control flowchart illustrating a second embodiment of the present invention. This embodiment may employ the same circuit configuration as the first embodiment.

First, in Steps ST11 to ST31, the period of revolution of the engine is calculated. Based on the calculation results, the base quantity of fuel is calculated in Step ST41. Next, in Step ST51, it is checked whether a cam angle signal was input during a crank angle interruption. If it was, the fuel injection quantity INJ1 (injector 15) and fuel injection quantity INJ2 (injector 16) are determined as follows (Step ST61): INJ1 is multiplied by a ratio of $\alpha$ and INJ2 is multiplied by a ratio of $(1-\alpha)$.

On the other hand, if it is found in Step ST51 that no cam angle signal was input, the fuel injection quantity INJ1 (injector 15) and fuel injection quantity INJ2 (injector 16) are determined as follows (Step ST71): INJ1 is multiplied by a ratio of $(1-\alpha)$ and INJ2 is multiplied by a ratio of $\alpha$. The injector drive is turned on (Step ST81), and finally the time of the current interruption of the crank angle is memorized (Step ST91). Then the process returns to the beginning.

The value of the ratio $\alpha$ is varied according to detected operating conditions of the engine, including engine speed, temporal variation in the engine speed, engine temperature information, the position of transmission gear of the engine, the throttle opening of the engine, and temporal variation in the throttle opening of the engine.

Changing the number of divisions of fuel injection quantity according to the operating conditions of the engine may further improve the air-fuel mixture formation during transitional periods In a low engine speed range, in particular, it is difficult for all the fuel injected this time to enter the cylinders because of low air inlet velocity as well as because of a time delay before the fuel injected by injectors reaches the cylinders through suction valves. Consequently, the air-fuel ratio of the current air-fuel mixture becomes lean to the extent that fuel remains upstream of the suction valves. This reduces the torque delivered by the engine. On the other hand, the air-fuel ratio of the next air-fuel mixture becomes richer by the amount of the extra air-fuel mixture which remained upstream of the suction valves. This extremely increases or decreases the torque delivered by the engine. The increases and decreases in the torque delivered by the engine increases car body vibrations and shocks. However, this embodiment can reduce the time delay because the multiple split injections are mainly carried out at least at a point just after the end of the suction stroke and at a point just before the start of the suction stroke.

Thus, by injecting a particular proportion of the fuel injection quantity earlier than the normal injection timing according to engine operation information, this embodiment also facilitates vaporization on port walls, reducing fuel delivery delay due to the port length and thus resulting in good combustion. This suppresses car body vibrations, shocks, etc As described above, the invention as set forth in claim 2 facilitates vaporization on port walls, reducing fuel delivery delay due to the port length and thus resulting in good combustion. This suppresses car body vibrations, shocks, etc., making it possible to control the fuel injection quantities during transitional periods easily and effectively in a simple manner.

Also, the invention as set forth in claim 2 improves the air-fuel mixture formation during transitional periods, contributing to suppression of car body vibrations, shocks, etc.

Also, the invention as set forth in claim 2 can reduce the delay in the delivery of injected fuel.

What is claimed is:

1. A fuel injection control device for an internal combustion engine, comprising:

angle detection means for detecting one angle reference position of at least the suction stroke or earlier strokes of two cylinders whose strokes shift from each other by 360 degrees of crank angle in a four-cycle multi-cylinder engine;

operating condition detection means for detecting the operating conditions of the engine; and fuel injection control means for determining the appropriate fuel injection quantity for each cylinder of the engine based on engine revolution information derived from the detected cycle of angle reference position detection signals obtained by said angle detection means and on operating condition detection signals obtained by said operating condition detection means, wherein ½ of the fuel injection quantity determined based on the engine revolution information derived from the detected cycle of the angle reference position detection signals of one of said two cylinders and on said operating condition detection signals is injected simultaneously into said two cylinders, and ½ of the fuel injection quantity determined based on the engine revolution information derived from the detected cycle of the angle reference position detection signals of the other of said two cylinders and on said operating condition detection signals is injected simultaneously into said two cylinders.

2. A fuel injection control device, comprising:

angle detection means fitted in the crank shaft of a four-cycle multi-cylinder engine and detecting angle reference position of the engine;

specific-cylinder detection means fitted in the cam shaft of said internal combustion engine and recognizing specific cylinders of the engine;

operating condition detection means for detecting the operating conditions of the engine; and fuel injection control means for determining the appropriate fuel injection quantity for each cylinder of the engine based on engine revolution information derived from the detected cycle of angle reference position detection signals obtained by said angle detection means and on operating condition detection signals obtained by said operating condition detection means, wherein a particular proportion of the fuel injection quantity determined based on the engine revolution information derived from the detected cycle of the angle reference position detection signals from said angle detection means and on said operating condition detection signals is divided into multiple injections, based on recognition information obtained by said specific-cylinder detection means.

3. The fuel injection control device according to claim 2, wherein the number of divisions of the fuel injection quantity determined based on the engine revolution information derived from the detected cycle of the angle reference position detection signals from said angle detection means and on the operating condition detection signals is changed according to the operating conditions of the engine.

4. The fuel injection control device according to claim 2, wherein the particular proportion of the fuel injection quantity determined based on the engine revolution information derived from the detected cycle of the angle reference position detection signals from said angle detection means and on the operating condition detection signals is changed according to the operating conditions of the engine.

5. The fuel injection control device according to claim 4, wherein the operating conditions of the engine which determine said particular proportion of the fuel injection quantity is changed according to at least engine speed.

6. The fuel injection control device according to claim 4, wherein the operating conditions of the engine which determine said particular proportion of the fuel injection quantity is changed according to at least the temporal variation in engine speed.

7. The fuel injection control device according to claim 4, wherein the operating conditions of the engine which determine said particular proportion of the fuel injection quantity is changed according to at least temperature information.

8. The fuel injection control device according to claim 4, wherein the operating conditions of the engine which determine said particular proportion of the fuel injection quantity is changed according to at least the position of the transmission gear of the engine.

9. The fuel injection control device according to claim 4, wherein the operating conditions of the engine which determine said particular proportion of the fuel injection quantity is changed according to at least the throttle opening of the engine.

10. The fuel injection control device according to claim 4, wherein the operating conditions of the engine which determine said particular proportion of the fuel injection quantity is changed according to at least temporal variation in the throttle opening of the engine.

11. The fuel injection control device according to claim 2, wherein said multiple split injections are mainly carried out at least at a point just after the end of the suction stroke and at a point just before the start of the suction stroke.

* * * * *